US006006374A

United States Patent [19]

Winnett et al.

[11] Patent Number: 6,006,374

[45] Date of Patent: Dec. 28, 1999

[54] SHOWERHEAD ATTACHMENT AND METHOD FOR GENERATING AROMAS

[76] Inventors: Harold G. Winnett, 19651 Greenbriar Dr., Tarzana, Calif. 91356; Bernard Ilan Urfig, 11777 San Vicente Bldg., No. 777, Los Angeles, Calif. 90049

[21] Appl. No.: 09/159,338

[22] Filed: Sep. 23, 1998

[51] Int. Cl.[6] ..... A61H 33/06

[52] U.S. Cl. ..... 4/525; 4/601; 4/605; 239/312; 239/590.3; 607/83

[58] Field of Search ..... 4/524, 525, 533, 4/534, 535, 597, 601, 605, 615; 239/312, 315, 316, 443, 553.3, 525, 590.3; 607/83

[56] References Cited

U.S. PATENT DOCUMENTS

| | | | |
|---|---|---|---|
| 843,260 | 2/1907 | Cloud . | |
| 877,045 | 1/1908 | Brooks . | |
| 1,146,353 | 7/1915 | Shapley . | |
| 1,264,772 | 4/1918 | Butler . | |
| 1,658,830 | 2/1928 | Bingham . | |
| 1,973,319 | 9/1934 | Nelson . | |
| 1,991,388 | 2/1935 | Healy | 239/312 |
| 2,058,901 | 10/1936 | McPherson . | |
| 2,189,936 | 2/1940 | Brandfon . | |
| 2,199,478 | 5/1940 | Bruzaud . | |
| 2,201,528 | 5/1940 | Freng . | |
| 2,238,969 | 4/1941 | Butterfield . | |
| 2,478,348 | 8/1949 | Wicker et al. . | |
| 2,602,699 | 7/1952 | Otto et al. . | |
| 2,609,232 | 9/1952 | Taulman . | |
| 2,659,627 | 11/1953 | McConnell . | |
| 2,907,528 | 10/1959 | Lambton . | |
| 2,975,980 | 3/1961 | Siebert et al. . | |
| 3,003,703 | 10/1961 | Lambton . | |
| 3,008,650 | 11/1961 | Prokop, Sr. . | |
| 3,018,969 | 1/1962 | Gentry . | |
| 3,106,345 | 10/1963 | Wukowitz . | |
| 3,134,545 | 5/1964 | Armond . | |
| 3,180,579 | 4/1965 | Tomaso . | |
| 3,199,788 | 8/1965 | Davis . | |
| 3,212,716 | 10/1965 | Mills et al. . | |
| 3,230,550 | 1/1966 | Carlson . | |
| 3,352,320 | 11/1967 | Camp . | |
| 3,461,870 | 8/1969 | Van Linge | 4/597 X |
| 3,486,695 | 12/1969 | Novak . | |
| 3,495,948 | 2/1970 | Long et al. . | |
| 3,655,135 | 4/1972 | Altman et al. . | |
| 3,764,074 | 10/1973 | James . | |
| 3797747 | 3/1974 | Buzzi et al. . | |

(List continued on next page.)

*Primary Examiner*—Robert M. Fetsuga
*Attorney, Agent, or Firm*—Thomas I. Rozsa; Tony D. Chen; Jerry Fong

[57] ABSTRACT

A showerhead attachment is used for generating aromas. The showerhead attachment holds an aroma containing material such as a gelatin type capsule to be intermixed with a portion of the running water and discharged through a discharge orifice. The showerhead attachment comprises a housing, a dispensing chamber, a removable and attachable cylinder, and a filter assembly. As water begins to flow through a water supply conduit, it will exit the conduit and enter into an inlet port of the housing to course through the housing and around the dispensing chamber and on through an outlet port, where the water will the flow through the showerhead into a cleansing stream raining down upon the bather. As the water enters the housing and flows around the dispensing chamber, a small portion of the total volumetric flow will enter an inlet orifice and will thus be diverted into an auxiliary water stream flowing into the dispensing chamber. The auxiliary water stream will proceed into a side compartment of the cylinder, where it will impinge upon the gelatin capsule, then flow down toward a bottom open end and around a connecting shaft end of an upper attachment portion. The pressure created by the auxiliary water stream onto the capsule will create in essence a squeezing effect upon the capsule and/or a dissipation of the capsule that will cause aromatic gel to trickle out through an upper orifice member, a bottom orifice member and the filter assembly.

32 Claims, 4 Drawing Sheets

U.S. PATENT DOCUMENTS 3,801,018 4/1974 Plotz .
3,842,447 10/1974 Usher .
3,847,354 11/1974 Lemond .
3,917,172 11/1975 O'Hare .
3,964,686 6/1976 Lopez .
4,055,278 10/1977 Seymour .
4,081,139 3/1978 Migliozzi .
4,131,232 12/1978 Pollinzi .
4,149,674 4/1979 Fukamizu et al. ..... 239/590.3 X
4,189,100 2/1980 Karp .
4,211,368 7/1980 Legros et al. .
4,218,013 8/1980 Davison .
4,281,796 8/1981 Fugent et al. .
4,363,146 12/1982 Liautuad ..... 239/590.3 X
4,397,050 8/1983 Davis et al. .
4,432,105 2/1984 Pitroda .
4,463,462 8/1984 Greenhut .
4,467,964 8/1984 Kaeser .
4,623,095 11/1986 Pronk .
4,872,225 10/1989 Wagner .
4,901,765 2/1990 Poe .
4,921,171 5/1990 Cupit .
4,956,883 9/1990 Lane .
5,004,158 4/1991 Halem et al. .
5,070,553 12/1991 Chambers .
5,093,943 3/1992 Wei .
5,274,858 1/1994 Berry .
5,305,476 4/1994 Ohyama et al. .
5,333,789 8/1994 Garneys .
5,351,892 10/1994 Conte .
5,454,516 10/1995 Smyrl .
5,788,160 8/1998 Woog ..... 4/605 X FIG.6
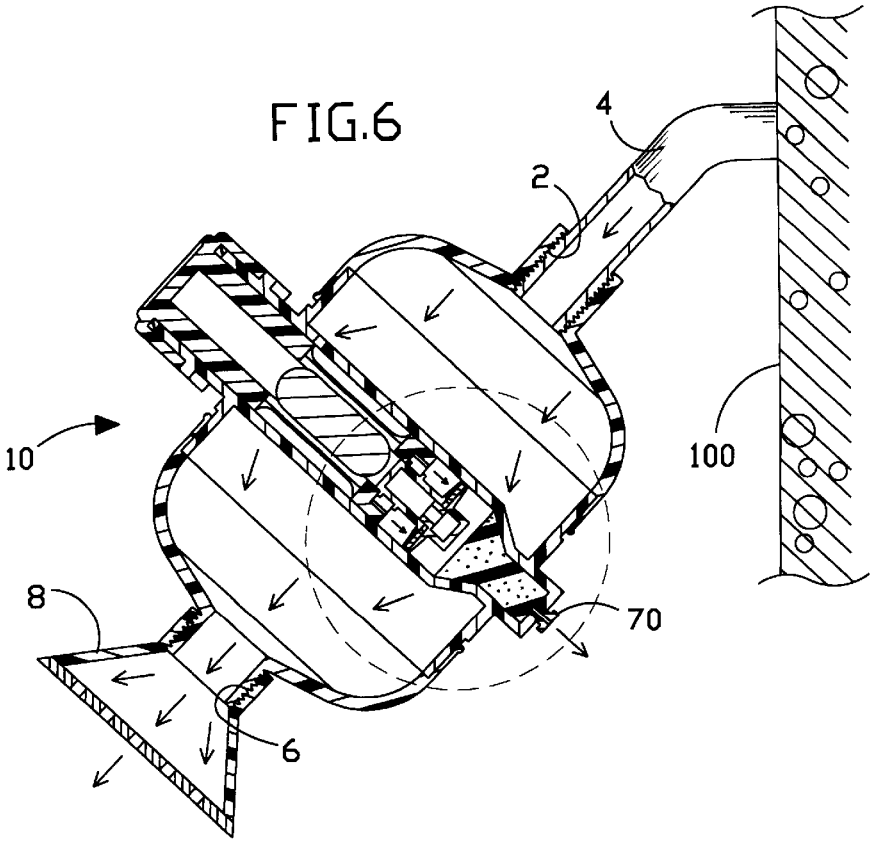
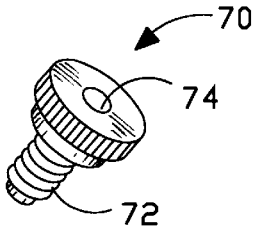
FIG.8
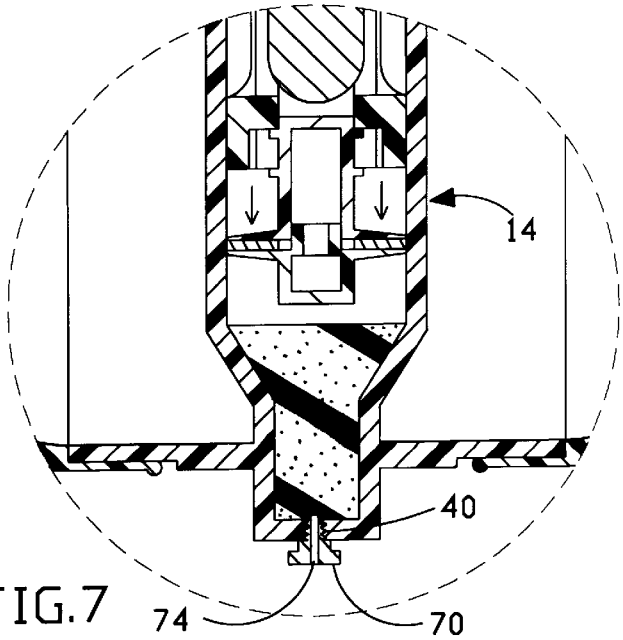
FIG.7

SHOWERHEAD ATTACHMENT AND METHOD FOR GENERATING AROMAS

BACKGROUND OF THE INVENTION

1. Field of the Invention

The present invention generally relates to the field of showerhead attachments. More particularly, the present invention relates to the field of showerhead attachments for creating a scented environment using running water and aromatic material.

2. Description of the Prior Art

Specifically, aromas which create soothing environments may have therapeutic properties and are increasingly being utilized as an alternative means of relaxation and a source of intense physical stimulation and pleasure. Certain aromas are well known to have a very soothing effect. One of the disadvantages with prior art devices is that they involve the addition of additives into the flow of water provided by a showerhead conduit, thereby exposing a user's body directly to the aromatic material and releasing only a small fraction into the ambient air. Another disadvantage with prior art devices is that creating such an aromatic environment in a bathroom or shower stall may cause problems when using burning candles or incense sticks due to high humidity and may result in the release of smoke in a small enclosed area.

The following sixty-one (61) prior art patents are found to be pertinent to the field of the present invention:

1. U.S. Pat. No. 843,260 issued to Cloud on Feb. 5, 1907 for "Bathing Apparatus" (hereafter the "Cloud Patent");
2. U.S. Pat. No. 877,045 issued to Brooks on Jan. 21, 1908 for "Spray" (hereafter the "Brooks Patent");
3. U.S. Pat. No. 1,146,353 issued to Shapley on Jul. 13, 1915 for "Faucet Attachment For Shower Baths" (hereafter the "Shapley Patent");
4. U.S. Pat. No. 1,264,772 issued to Butler on Apr. 30, 1918 for "Medical Liquid Deliverer Attachment For Water Pipes Of Bath Tubs" (hereafter the "Butler Patent");
5. U.S. Pat. No. 1,658,830 issued to Bingham on Feb. 14, 1928 for "Medicinal Spraying Device" (hereafter the "Bingham Patent");
6. U.S. Pat. No. 1,973,319 issued to Nelson on Sep. 11, 1934 for "Soap And Crystal Dispenser" (hereafter the "Nelson Patent");
7. U.S. Pat. No. 2,058,901 issued to McPherson on Oct. 27, 1936 for "Solution Making And Dispensing Apparatus" (hereafter the "McPherson Patent");
8. U.S. Pat. No. 2,189,936 issued to Brandfon on Feb. 13, 1940 for "Mixer For Deliquescent Bath Spray Tablets" (hereafter the "Brandfon Patent");
9. U.S. Pat. No. 2,199,478 issued to Bruzaud on May 7, 1940 for "Shower Head" (hereafter the "Bruzaud Patent");
10. U.S. Pat. No. 2,201,528 issued to Freng on May 21, 1940 for "Apparatus For Adding Extracts Or The Like To Shower Baths" (hereafter the "Freng Patent");
11. U.S. Pat. No. 2,238,969 issued to Butterfield on Apr. 22, 1941 for "Dishwashing Apparatus" (hereafter the "Butterfield Patent");
12. U.S. Pat. No. 2,478,348 issued to Wicker et al. on Aug. 9, 1949 for "Sanitary Shower Stall" (hereafter the "Wicker Patent");
13. U.S. Pat. No. 2,602,699 issued to Otto et al. on Jul. 8, 1952 for "Mixing Device For Water Lines" (hereafter the "Otto Patent");

14. U.S. Pat. No. 2,609,232 issued to Taulman on Sep. 2, 1952 for "Shower" (hereafter the "Taulman Patent");
15. U.S. Pat. No. 2,659,627 issued to McConnell on Nov. 17, 1953 for "Shower Head" (hereafter the "McConnell Patent");
16. U.S. Pat. No. 2,907,528 issued to Lambton on Oct. 6, 1959 for "Mixing Device For Delivering Liquid Mixtures Or Solutions" (hereafter the "Lambton Patent");
17. U.S. Pat. No. 2,975,980 issued to Siebert et al. on Mar. 21, 1961 for "Shower Heads" (hereafter the "Siebert Patent");
18. U.S. Pat. No. 3,003,703 issued to Lambton on Oct. 10, 1961 for "Device For Delivering Liquid Mixtures" (hereafter the "Lambton Patent");
19. U.S. Pat. No. 3,008,650 issued to Prokop, Sr. on Nov. 14, 1961 for "Shower Head" (hereafter the "Prokop Patent");
20. U.S. Pat. No. 3,018,969 issued to Gentry on Jan. 30, 1962 for "Dual Purpose Shower Head Assembly" (hereafter the "Gentry Patent");
21. U.S. Pat. No. 3,106,345 issued to Wukowitz on Oct. 8, 1963 for "Shower Bath Water Control With Additive Attachment" (hereafter the "Wukowitz Patent");
22. U.S. Pat. No. 3,134,545 issued to Armond on May 26, 1964 for "Water And Soap Shower Spray" (hereafter the "Arnond Patent");
23. U.S. Pat. No. 3,180,579 issued to Tomaso on Apr. 27, 1965 for "Tubular Container Holder For Shower Head" (hereafter the "Tomaso Patent");
24. U.S. Pat. No. 3,199,788 issued to Davis on Aug. 10, 1965 for "Dispenser" (hereafter the "Davis Patent");
25. U.S. Pat. No. 3,212,716 issued to Mills et al. on Oct. 19, 1965 for "Materials Dispensing Shower Head Device" (hereafter the "Mills Patent");
26. U.S. Pat. No. 3,230,550 issued to Carlson on Jan. 25, 1966 for "Sanitary Shower Stall" (hereafter the "Carlson Patent");
27. U.S. Pat. No. 3,352,320 issued to Camp on Nov. 14, 1967 for "Shower Head Valve" (hereafter the "Clamp Patent");
28. U.S. Pat. No. 3,486,695 issued to Novak on Dec. 30, 1969 for "Shower Water Additive Dispensing Apparatus" (hereafter the "Novak Patent");
29. U.S. Pat. No. 3,495,948 issued to Long et al. on Feb. 17, 1970 for "Bypass Chemical Dissolver" (hereafter the "Long Patent");
30. U.S. Pat. No. 3,655,135 issued to Altman et al. on Apr. 11, 1972 for "Steam Outlet Head With A Dispenser For Fragrance Or Medicant" (hereafter the "Altman Patent");
31. U.S. Pat. No. 3,764,074 issued to James on Oct. 9, 1973 for "Shower Head And Liquid Agent Dispensing Attachment" (hereafter the "James Patent");
32. U.S. Pat. No. 3,797,747 issued to Buzzi et al. on Mar. 19, 1974 for "Device For Aspirating And Admixing Additives Into A Stream" (hereafter the "Buzzi Patent");
33. U.S. Pat. No. 3,801,018 issued to Plotz on Apr. 2, 1974 for "Shower Head" (hereafter the "Plotz Patent");
34. U.S. Pat. No. 3,842,447 issued to Usher on Oct. 22, 1974 for "Device For The Introduction Of Fluent Medium Into A Main Flow Of Liquid Passing Along A Closed Passage, Such As A Pipe" (hereafter the "Usher Patent");

35. U.S. Pat. No. 3,847,354 issued to Lemond on Nov. 12, 1974 for "Shower Head Additive Dispenser" (hereafter the "Lemond Patent");
36. U.S. Pat. No. 3,917,172 issued to O'Hare on Nov. 4, 1975 for "Fluid Mixing And Dispensing Apparatus" (hereafter the "O'Hare Patent");
37. U.S. Pat. No. 3,964,686 issued to Lopez on Jun. 22, 1976 for "Showerhead With Secondary Liquid Dispenser" (hereafter the "Lopez Patent");
38. U.S. Pat. No. 4,055,278 issued to Seymour on Oct. 25, 1977 for "Dispensing Shower Head" (hereafter the "Seymour Patent");
39. U.S. Pat. No. 4,081,139 issued to Migliozzi on Mar. 28, 1978 for "Multi-Carrier Dispenser Fixture For Shower Heads" (hereafter the "Migliozzi Patent");
40. U.S. Pat. No. 4,131,232 issued to Pollinzi on Dec. 26, 1978 for "Automatic Shower Dispenser" (hereafter the "Pollinzi Patent");
41. U.S. Pat. No. 4,189,100 issued to Karp on Feb. 19, 1980 for "Fluid Dispenser For A Shower Bath" (hereafter the "Karp Patent");
42. U.S. Pat. No. 4,211,368 issued to Legros et al. on Jul. 8, 1980 for "Device For Aerating And Chemically Activating Shower Water" (hereafter the "Legros Patent");
43. U.S. Pat. No. 4,218,013 issued to Davison on Aug. 19, 1980 for "Shower Head Fluid Dispenser" (hereafter the "Davison Patent");
44. U.S. Pat. No. 4,281,796 issued to Fugent et al. on Aug. 4, 1981 for "Bathroom Mixing Device" (hereafter the "Fugent Patent");
45. U.S. Pat. No. 4,397,050 issued to Davis et al. on Aug. 9, 1983 for "Quick Shower Or Power Shower" (hereafter the "Davis Patent");
46. U.S. Pat. No. 4,432,105 issued to Pitroda on Feb. 21, 1984 for "Shower Device" (hereafter the "Pitroda Patent");
47. U.S. Pat. No. 4,463,462 issued to Greenhut on Aug. 7, 1984 for "Shower Dispensing Container-Receiver Coupling System" (hereafter the "Greenhut Patent");
48. U.S. Pat. No. 4,467,964 issued to Kaeser on Aug. 28, 1984 for "Automatic Mixing Device For Use In A Shower Head" (hereafter the "Kaeser Patent");
49. U.S. Pat. No. 4,623,095 issued to Pronk on Nov. 18, 1986 for "Liquid Adding Apparatus And Method For A Shower Fixture" (hereafter the "Pronk Patent");
50. U.S. Pat. No. 4,872,225 issued to Wagner on Oct. 10, 1989 for "Cleaning Apparatus And Method For Bath Enclosures " (hereafter the "Wagner Patent");
51. U.S. Pat. No. 4,901,765 issued to Poe on Feb. 20, 1990 for "Coupling For Mixing Lotions Or Other Liquids With Shower Water" (hereafter the "Poe Patent");
52. U.S. Pat. No. 4,921,171 issued to Cupit on May 1, 1990 for "Showerhead Dispenser" (hereafter the "Cupit Patent");
53. U.S. Pat. No. 4,956,883 issued to Lane on Sep. 18, 1990 for "Shower Fixture" (hereafter the "Lane Patent");
54. U.S. Pat. No. :5,004,158 issued to Halem et al. on Apr. 2, 1991 for "Fluid Dispensing And Mixing Device" (hereafter the "Halem Patent");
55. U.S. Pat. No. 5,070,553 issued to Chambers on Dec. 10, 1991 for "Showerhead Assembly" (hereafter the "Chambers Patent");
56. U.S. Pat. No. 5,093,943 issued to Wei on Mar. 10, 1992 for "Multi-Function Shower Head" (hereafter the "Wei Patent");
57. U.S. Pat. No. 5,274,858 issued to Berry on Jan. 4, 1994 for "Shower Soap System" (hereafter the "Berry Patent");
58. U.S. Pat. No. 5,305,476 issued to Ohyama et al. on Apr. 26, 1994 for "Shower Bathing Device" (hereafter the "Ohyama Patent");
59. U.S. Pat. No. 5,333,789 issued to Garneys on Aug. 2, 1994 for "Soap Dispenser Insert For A Shower Head" (hereafter the "Garneys Patent");
60. U.S. Pat. No. 5,351,892 issued to Conte on Oct. 4, 1994 for "Unitary, Multi-Purpose, Self-Contained Selection, Dilution, Mixing And Dispensing Apparatus" (hereafter the "Conte Patent"); and
61. U.S. Pat. No. 5,454,516 issued to Smyrl on Oct. 3, 1995 for "Showerhead With Selectable Liquid Dispenser" (hereafter the "Smyrl Patent").

The Cloud Patent discloses a bathing apparatus. It comprises a cylindrical casing with an upper head removably secured thereto and a lower head removably secured thereto, where the upper head is adapted to connect with any convenient source of water supply. The cylindrical casing receives and stores a bar of soap or other matter therein. The water entering the cylindrical casing will dissolve the soap, in which the water and the dissolved soap enter into a hose which is connected to a delivery chamber for delivering water and the dissolved soap to a user.

The Brooks Patent discloses a spray which is adapted to be connected to a water supply pipe. The spray has a plurality of chambers for receiving a chemical ingredient therein. A rotating mechanism is attached to the spray for rotating and directing a flow of water to one of the chambers under pressure for spraying the water from the spray.

The Shapley Patent discloses a faucet attachment for shower baths. It is a simple and comparatively inexpensive shower bath attachment which is clamped to any faucet and adjusted to any angle within a limited range for directing the jets of water to the desired locations.

The Butler Patent discloses a medical liquid deliverer attachment for water pipes of bath tubs. It comprises a hollow container with a removable cover and an integral bottom end. An opposite tube is threadedly engaged with a spray head.

The Bingham Patent discloses a medicinal spraying device. It comprises an outer casing which has a base and a top detachably secured to the base. A handle portion is attached to the base for receiving a flexible hose to supply water to the outer casing of the spraying device.

The Nelson Patent discloses a soap and crystal dispenser which is attached to a water spray nozzle.

The McPherson Patent discloses a solution making and dispensing apparatus.

The Brandfon Patent discloses a mixer for deliquescent bath spray tablets. It comprises a hollow cylinder container with a hollow tube which extends outside of the container and connects between a showerhead and a water supply conduit. In the midway portion the tube are a series of small perforations for discharging liquid and causing turbulent condition therein. At an upper portion of the tube there is a small transverse duct open at one of its ends to the hollow container and having in its upper side an orifice. A tablet of perfume or medicate material is disposed within the container. The water flows through the tube, a portion entering the duct through the orifice to be discharged at its open end, partially filling the container therefore to reenter the tube through the small perforations in a charged condition so that the water will be perfumed or medicated by the immersed tablet and mixed with the outflow to be dispensed by the spray head.

The Bruzaud Patent discloses a showerhead.

The Freng Patent discloses an apparatus for adding extracts or the like to shower baths. It comprises a piston pump and an exchangeable vessel for extract.

The Butterfield Patent discloses a dishwashing apparatus.

The Wicker Patent discloses a sanitary shower stall.

The Otto Patent discloses a mixing device for water lines.

The Taulman Patent discloses a shower.

The McConnell Patent discloses a showerhead.

The Lambton Patent discloses a mixing device for delivering liquid mixtures or solutions. It comprises a housing with an inlet and outlet openings for the water and holding means engageable with a closed container within the housing and filled with the substance to be mixed with the water to open the container and permit discharge of the contents of the container into the housing.

The Siebert Patent discloses showerheads.

The Lambton Patent discloses a device for delivering liquid mixtures. It comprises a housing with a cylindrical portion which merges into a belled portion. The cylindrical portion has a bore which provides the inlet opening for the water to enter into the housing while the outer end of the belled portion is closed by a detachable perforated cover which provides the outlet and through which the liquid issues as spray.

The Prokop Patent discloses a showerhead.

The Gentry Patent discloses a dual purpose showerhead assembly.

The Wukowitz Patent discloses a shower bath water control with an additive attachment. The attachment has a section of conduit with an upper end connected to a main water supply conduit and a lower end connected to a showerhead. The attachment also includes a downwardly extending pipe portion containing a valve which is regulated by a handle to control the rate of flow of liquid through the pipe portion from a container holding the liquid.

The Armond Patent discloses a water and soap shower spray which is mounted parallel to the main showerhead.

The Tomaso Patent discloses a tubular container holder for a showerhead.

The Davis Patent discloses a dispenser which is coupled into a main water supply conduit. The dispenser has a mechanism which manually controls the amount of substance into the shower water. The mechanism serves to dispense the substance into the shower water under pressure from an expendable aerosol water.

The Mills Patent discloses a materials dispensing showerhead device. It comprises a valve mechanism which has a position to provide communication between a soap container and another position to provide a flow restriction in a water flow passage through the device, thereby creating a lower pressure area by the flow restriction to aspirate liquid soap out of the soap container and into the shower water flow stream.

The Carlson Patent discloses a sanitary shower stall.

The Camp Patent discloses a showerhead valve.

The Novak Patent discloses a shower water additive dispensing apparatus. It comprises a plurality of additive reservoirs, a multiple position valve, a timing valve, and separate conduits with metering valves for metering the rate of flow of shower water additive through the conduits to the multiple position valve.

The Long Patent discloses a bypass chemical dissolver.

The Altman Patent discloses a steam outlet head with a dispenser for a fragrance or medicant. It has an inlet port, an outlet port and a connecting interior channel for passage of steam through the head. A reservoir is positioned on top of the steam outlet head for retaining the fragrance. An orifice connects the reservoir with the channel to mix the fragrance or medicant with the steam passing through the head.

The James Patent discloses a shewerhead and liquid agent dispensing attachment. It comprises a valve which interconnects a source of pressurized water and a supply of liquid agent to a showerhead by which one control adjustment accomplishes proportioning, mixing and aeration of the fluid.

The Buzzi Patent discloses a device for aspirating and admixing additives into a stream. It comprises an injector with a main bore, increasing in width in the flow direction, and suction bores communicating with the main bore. A liquid-return-flow interrupter is arranged at the inlet side of the injector and is in the form of a free jet air chamber communicating with the open air through corresponding openings and adapted to be bridge by the liquid concentrated into a fine jet by a nozzle bore.

The Plotz Patent discloses a showerhead.

The Usher Patent discloses a device for the introduction of fluent medium into a main flow of liquid passing along a closed passage. The device has a casing adapted to connected with the passage so that a fluent medium feed cavity in the casing communicates hydraulically with the passage as a result of forming a break in the passage.

The Lemond Patent discloses a showerhead additive dispenser. It comprises a centrally bored tubular member with opposite ends respectively connected to a showerhead and a main water supply conduit for passage of the shower water through the bore. A removably attachable container is connected to the tubular member by tubes. A control valve is provided to control the amount of water diverted from an inlet portion of the bored tubular member into and through the container so that such diverted water may pick up bath oil or other additives contained within the container and carry them back into the tubular member on an outlet side for mixing with the main flow of water going to the showerhead.

The O'Hare Patent discloses a fluid mixing and dispensing apparatus.

The Lopez Patent discloses a showerhead with a secondary liquid dispenser. The showerhead has a compartment in which a hygienic liquid is stored and selectively mixed into the water stream. A valve is positioned in the compartment and a valve operator disposed outside the showerhead selectively opens the valve to dispense the liquid.

The Seymour Patent discloses a dispensing showerhead. It comprises an enclosure adapted to be connected to a water supply. The enclosure has a container which carries a cartridge rotatable to present different bath preparations to a stream of water passing through a flow path in the enclosure and out of a showerhead opening in one end of the enclosure.

The Migliozzi Patent discloses a multi-carrier dispenser fixture for showerheads.

The Pollinzi Patent discloses an automatic shower dispenser for automatically mixing controlled amounts of liquid additive to the shower water. The dispenser is attachable to the water inlet pipe and includes a plastic refillable container for holding the liquid additive and dispensing it under the flow of gravity. A valve is positioned over the mouth of the receptacle for controlling the flow of the liquid additive.

The Karp Patent discloses a fluid dispenser for a showerhead. The dispenser is mounted between a pressurized water pipe and a shower nozzle. A fluid reservoir is mounted on top of the dispenser for storing the fluid to be dispensed.

The Legros Patent discloses a device for aerating and chemically activating shower water. The device is attached to the showerhead. It comprises a first mixing chamber for mixing water and air, and a second mixing chamber for mixing the aerated water with a chemical.

The Davison Patent discloses a showerhead fluid dispenser. It comprises a valve block for selectively dispensing one of plurality of select liquids into the water stream discharged by the shower nozzle.

The Fugent Patent discloses a bathroom mixing device. It comprises a main body with two opposite passages for communicating with a cylindrical chamber. A revolvable cylinder is located within the chamber for control of and routing of fluids passing therethrough.

The Davis Patent discloses a quick shower or power shower.

The Pitroda Patent discloses a shower device which stores one or more additives, and allows injection and mixing of the additives into the water stream delivered to a showerhead. A passage for the water stream provides a pressure differential sufficient to draw the additives into the water stream, while check valves are used to prevent backflow of the additives The Greenhut Patent discloses a shower dispenser container-receiver coupling system. The system is used for connecting a bottle to a shower dispenser. The bottle has a cam on its neck and the shower dispenser receiver into which the container can be screwed has a slot forming a detent that is deflected by the cam as the container is turned, to resist unscrewing in of the container.

The Kaeser Patent discloses an automatic mixing device for use in a showerhead.

The Pronk Patent discloses a liquid adding apparatus and method for a shower fixture. The apparatus adds the liquid soap or some other liquid to the water stream which flows through a showerhead.

The Wagner Patent discloses a cleaning apparatus and method for bath enclosures.

The Poe Patent discloses a coupling for mixing lotions or other liquids with shower water. It comprises a coupling body with an inlet portion and an outlet portion with a flow path. A mixing chamber is mounted in fluid communication with the flow path through the coupling body which serves to selectively mix liquid with the water.

The Cupit Patent discloses a showerhead dispenser. It comprises a showerhead mounted to discharge a water spray along a declining axis and a reservoir mounted on top of the showerhead and having a discharge port immediately adjacent and alongside the spray outlet of the showerhead.

The Lane Patent discloses a shower fixture for dispensing liquid soap into or adjacent to a water stream emitted from a primary showerhead.

The Halem Patent discloses a fluid dispensing and mixing device for dispensing a predetermined total amount of a selected additive into a water steam, with the rate of mixing of the additive and water being controlled by the water pressure. A pump is used to dispense the additive from a storage chamber.

The Chambers Patent discloses a shower head assembly.

The Wei Patent discloses a multi-function showerhead. It comprises a showerhead body mounted at the upper end of a grip several units for making bubbles, message, scrubbing, etc. passable to be selectably and additionally attached on the showerhead body.

The Berry Patent discloses a shower soap system.

The Ohyama Patent discloses a shower bathing device. It comprises a passage through which hot water is passed, a chamber filled with medical solution to supply the medical solution into the passage, a stream pump for mixing the medical solution in the chamber with hot water passing through the passage, and a screw inserted into a through hole for adjusting the amount of the medical solution supplied to the stream pump.

The Garneys Patent discloses a soap dispenser insert for a showerhead.

The Conte Patent discloses an unitary, multi-purpose, self-contained selection, dilution, mixing and dispensing apparatus.

The Smyrl Patent discloses a showerhead with selectable liquid dispenser.

It is highly desirable to have a very efficient and also very effective design and construction of a showerhead attachment for generating aromas. It is also desirable to provide a showerhead attachment with the capability of creating an aromatic environment in a bathroom or a shower stall, that will do so by using the force of the pressurized water supply, and that will avoid exposing the person's body directly to the aromatic material.

SUMMARY OF THE INVENTION

The present invention is a unique showerhead attachment for generating aromas. The showerhead attachment holds an aroma containing material such as a gelatin type capsule or a piece of harden material which will last longer, to be intermixed with a portion of the running water and discharged through a discharge orifice.

The showerhead attachment comprises a housing, a dispensing chamber, a removable and attachable cylinder, and a filter assembly. As water begins to flow through a water supply conduit, it will exit the conduit and enter into an inlet port of the housing to course through the housing and around the dispensing chamber and on through an outlet port, where the water will then flow through the showerhead into a cleansing stream raining down upon the bather. As the water enters the housing and flows around the dispensing chamber, a small portion of the total volumetric flow will enter an inlet orifice and will thus be diverted into an auxiliary water stream flowing into the dispensing chamber. The auxiliary water stream will proceed into a side compartment of the cylinder, where it will impinge upon the gelatin capsule, then flow down toward a bottom open end and around a connecting shaft end of an upper attachment portion. The pressure created by the auxiliary water stream onto the capsule will create in essence a squeezing effect upon the capsule and/or a dissipation of the capsule that will cause aromatic gel to trickle out through an upper orifice member, a bottom orifice member and the filter assembly, and intermix with the auxiliary water stream being expelled out of a discharge orifice. The small size of the discharge orifice will cause the aromatic auxiliary water stream mixture to be ejected as a fine spray which due to the close proximity of the discharge orifice to the shower wall, will strike forcefully against the wall and atomize to disperse throughout the bathroom or shower stall atmosphere and thereby create a scented environment.

As water continues to flow through the housing and into the dispensing chamber, the capsule will begin to dissolve due to the heat and capsule dissipating action of the running water and eventually release greater quantities of the aromatic gel into the water stream. A jet nozzle can be used with tie showerhead attachment, where the jet nozzle is threadedly engaged with the discharge orifice of the dispensing chamber.

It is an object of the present invention to provide a showerhead attachment for creating a scented environment by releasing an aroma containing material into the atmosphere.

It is a further object of the present invention to provide a showerhead attachment for creating an aromatic environment in a bathroom or a shower stall, that will do so by using the force of the pressurized water supply, and that will avoid exposing the person's body directly to the aromatic material.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated:

FIG. 6 is a cross-sectional view of an alternative embodiment of the present invention showerhead attachment coupled between a showerhead and a main water supply conduit;

FIG. 7 is an enlarged partial cross-sectional view taken within the dashed lines of FIG. 6; and FIG. 8 is a front perspective view of a jet nozzle.

DESCRIPTION OF THE PREFERRED EMBODIMENT

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
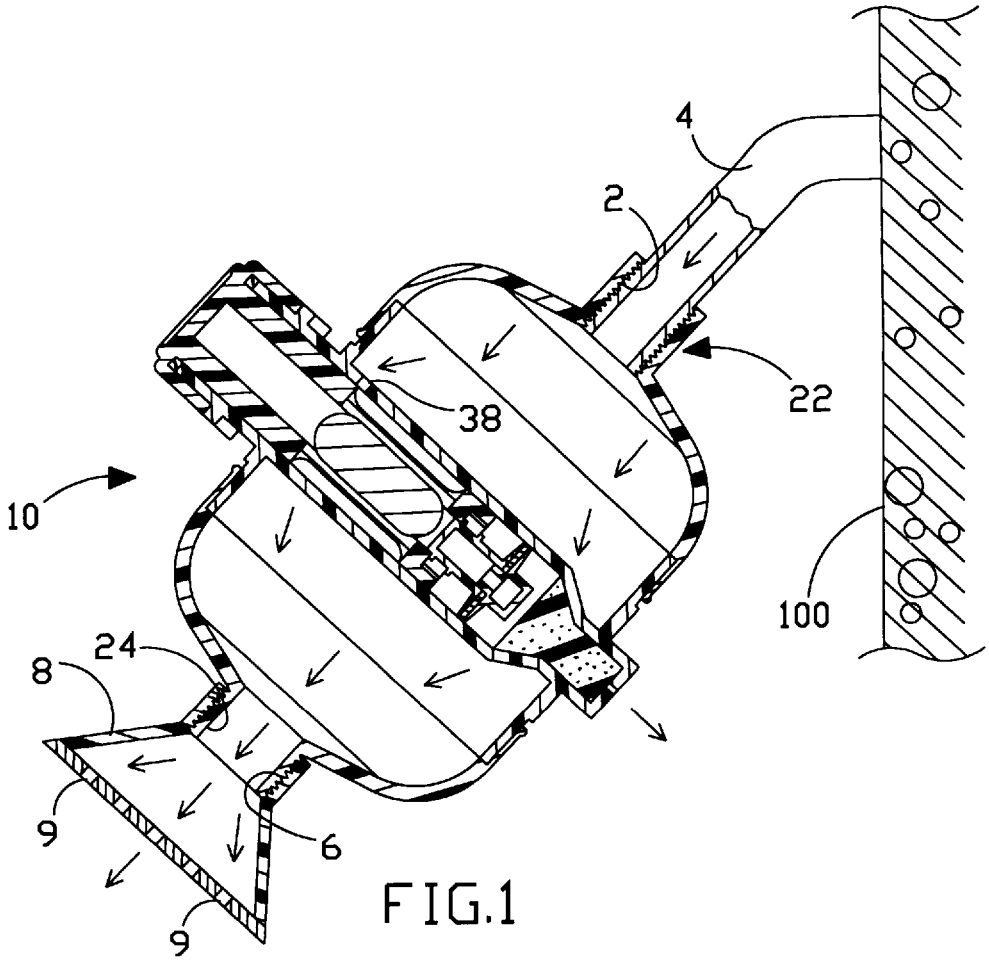
FIG. 1 is a cross-sectional view of a preferred embodiment of the present invention showerhead attachment coupled between a showerhead and a main water supply conduit.
Figure 2:
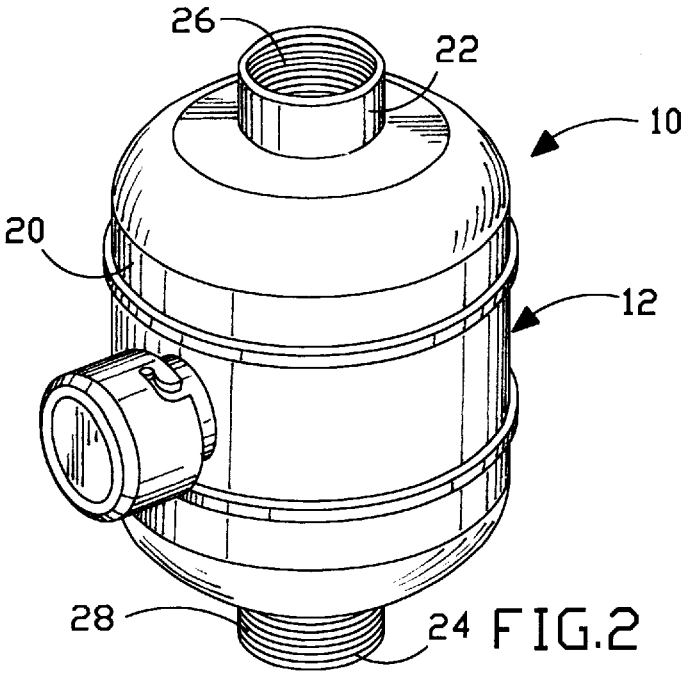
FIG. 2 is a perspective view of the present invention showerhead attachment shown in FIG. 1.

Referring to FIG. 1, there is shown at 10 the present invention showerhead attachment for generating and releasing aromas into the atmosphere of a bathroom or shower stall (not shown).

Referring to FIGS. 1 through 5, the present invention showerhead attachment 10 comprises a generally cylindrical housing 12, a generally cylindrical shaped dispensing chamber 14, a generally elongated removable and attachable holding cylinder 16, and a filter assembly 18. The housing 12 has a circumferential sidewall 20, a water inlet port 22, a water outlet port 24 axially aligned with the inlet port 22, and a water flow passage which extends from the inlet port 22 to the outlet port 24. The water inlet port 22 has inner threads 26 for threadedly engaging with outer threads 2 of a water supply conduit 4. The water outlet port 24 has outer threads 28 for threadedly engaging with inner threads 6 of a showerhead 8.

Figure 5:
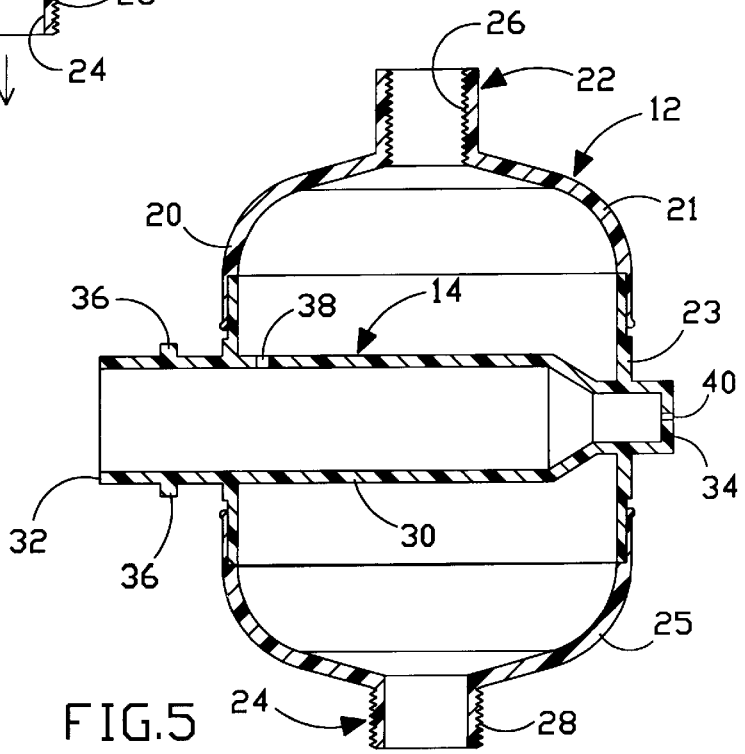
FIG. 5 is an enlarged longitudinal sectional view of the housing of the present invention showerhead attachment shown in FIG. 1.

Referring to FIG. 5, it will be appreciated that the housing 12 may be constructed in a generally three piece configuration which includes a top section 21, a middle section 23 and a bottom section 25, and all are tightly press fitted together to form the cylindrical housing 12. It is emphasized that while the three piece configuration is preferred, it is also within the spirit and scope of the present invention to have a generally unitary configuration of the housing 12. In addition, the three sections may be further secured together by glue or other suitable means to seal the housing. The housing 12 must be water tight and durable, and therefore the housing can be made of strong plastic material or any other suitable material known to one skilled in the art.

The cylindrical shaped dispensing chamber 14 has a circumferential sidewall 30, an open top end 32 and a closed bottom end 34. The exterior surface of the circumferential sidewall 30 is integrally formed with the middle section 23 of the housing 12 such that the open top end 32 and the closed bottom end 34 extend through the circumferential sidewall 20 of the housing 12 at opposite locations. The circumferential sidewall 30 has two opposite flanges 36 and an inlet orifice 38 facing in the direction of the water inlet port 22 for diverting a portion of incoming water thereto. The closed end 34 has a discharge orifice 40 for discharging a mist of water from the inlet orifice 38.

Figure 3:
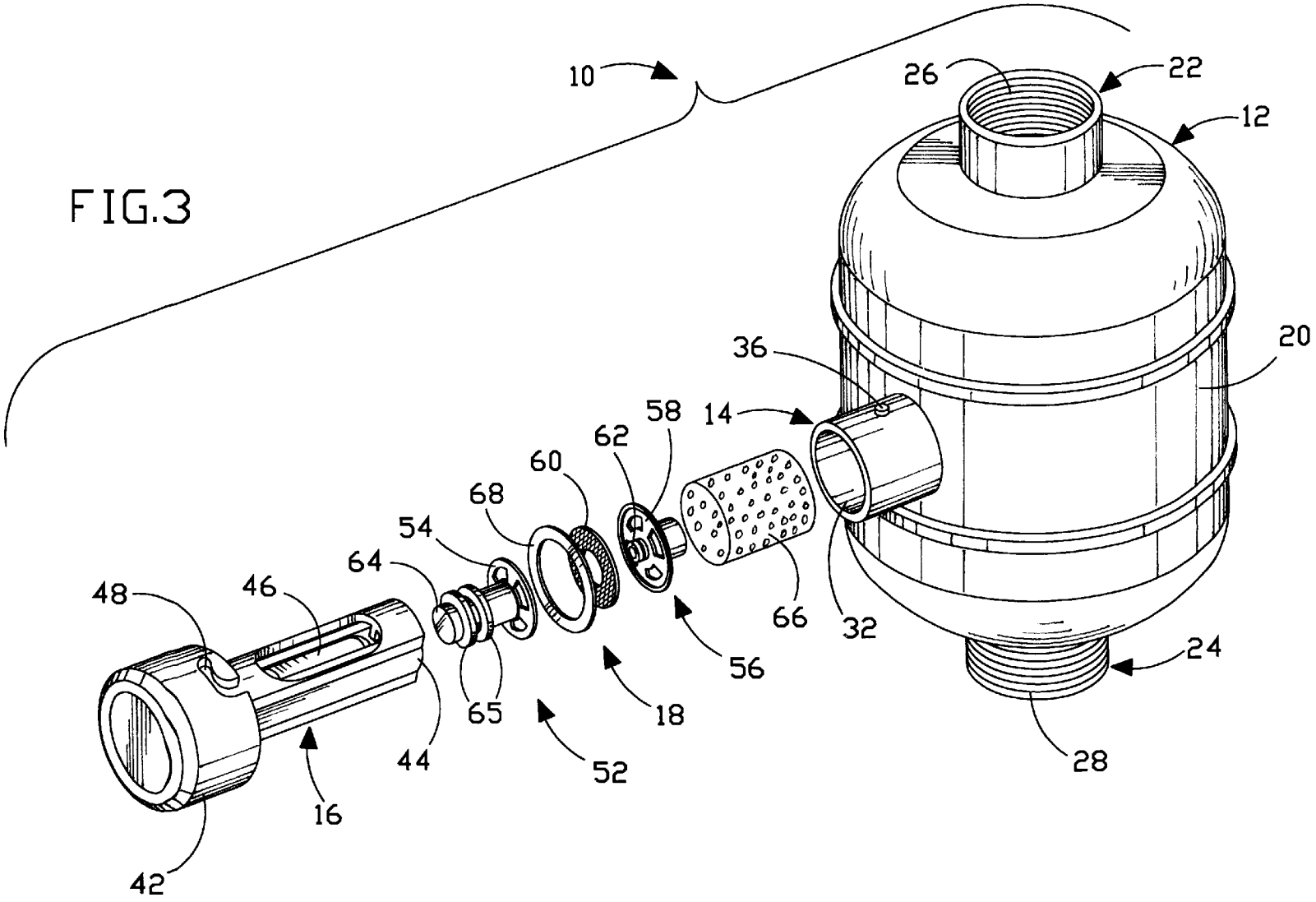
FIG. 3 is an enlarged exploded perspective view of the present invention showerhead attachment shown in FIG. 1.
Figure 4:
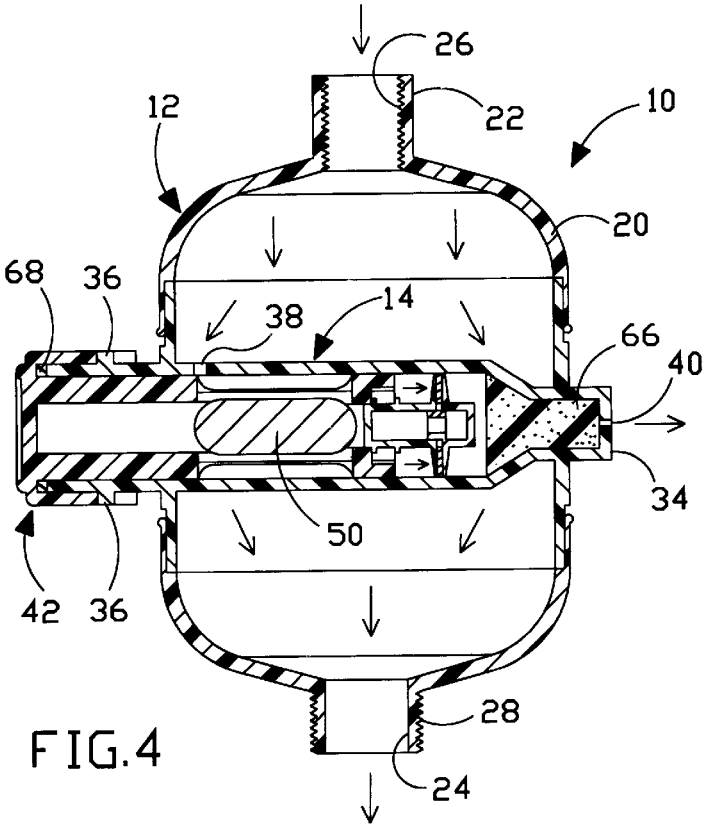
FIG. 4 is an enlarged longitudinal sectional view of the present invention showerhead attachment shown in FIG. 1.

Referring to FIGS. 3 and 4, the removable and attachable cylinder 16 has an upper cap portion 42 integrally formed thereto, an open bottom end 44 and a side compartment 46. The cap portion 42 has opposite closing latches 48 (only one is shown) for engaging with the two opposite flanges 36 of the dispensing chamber 14 to fasten the cap portion 42 against the top open end 32 of the dispensing chamber 14. The side compartment 46 is large enough to receive an aroma containing material 50 such as a gelatin type capsule or a piece of harden material which will last longer.

The filter assembly 18 will ensure that the relatively small discharge orifice 40 does not become clogged with any particulates that may be found in the gelatin capsule 50 or the water supplied by the water supply conduit 4. The filter assembly 18 includes an upper attachment portion 52 with an upper orifice disk-shaped member 54, a bottom connection portion 56 with a bottom orifice disk-shaped member 58, and a disk-shaped filter 60 which is constructed of a fine wire mesh screen or fabric mesh screen. The bottom connection portion 56 has a connecting shaft end 62 which is press fitted to a bottom open end of the upper attachment portion 52 such that the disk-shaped filter 60 is sandwiched between the upper and bottom orifice disk-shaped members 54 and 58, respectively. The upper attachment portion 52 also has a connecting shaft end 64 which is inserted into and secured to the bottom open end 44 of the cylinder 16 by lateral ribs 65. A rubber sponge 66 is also provided with the filter assembly 18 and is inserted into and positioned at the bottom closed end 34 of the dispensing chamber 14 adjacent to the discharge orifice 40 for further preventing clogging with any particulates that may be found in the gelatin capsule 50 or the water supplied by the water supply conduit 4.

The cylinder 16 and the filter assembly 18 are then installed and inserted into the dispensing chamber 14 such that the upper cap portion 42 is engaged with the top open end 32 of the dispensing chamber 14 to seal the dispensing chamber 14 and the side compartment 46 of the cylinder 16 is aligned with the inlet orifice 38 of the dispensing chamber 14. A rubber O-ring seal 68 is provided and installed between the interior of the cap portion 42 and the upper rim of the open end 32 of the dispensing chamber 14 to further make the dispensing chamber 14 water tight.

Referring again to FIGS. 1 and 4, as water begins to flow through the conduit 4, it will exit the conduit and enter into the inlet port 22 of the housing 12 to course through the housing 12 and around the dispensing chamber 14 and on through the outlet port 24, where the water will then flow through the showerhead and through showerhead apertures 9 into a cleansing stream raining down upon the bather. As the water enters the housing 12 and flows around the dispensing chamber 14, a small portion of the total volumetric flow will enter the inlet orifice 38 and will thus be diverted into an auxiliary water stream flowing into the dispensing chamber 14. The auxiliary water stream will proceed into the side compartment 46 of the cylinder 16, where it will impinge upon the gelatin capsule 50 then flow down toward the bottom open end 44 and around the connecting shaft end 64 of the upper attachment portion 52. The pressure created by the auxiliary water stream onto the capsule 50 will create in essence a squeezing effect upon the capsule 50 and/or a dissipation of the capsule that will cause aromatic gel to trickle out through the upper orifice member 54, the bottom orifice member 58 and the filter 60, and intermix with the auxiliary water stream being expelled out of the discharge orifice 40. The amount of gel trickling out is quite small, thereby ensuring a prolonged release of aromatic material. The small size of the discharge orifice 40 will cause the aromatic auxiliary stream mixture to be ejected as a fine spray which due to the close proximity of the discharge orifice 40 to the shower wall 100, will strike forcefully against the wall 100 and atomize to disperse throughout the bathroom or shower stall atmosphere and thereby create a scented environment. The filter 60 and the sponge 66 will ensure that the relatively small discharge orifice 40 does not become clogged with any particulates that may be found in the capsule 50 or the water supplied by the shower conduit 4.

As water continues to flow through the housing 12 and into the dispensing chamber 14, the capsule 50 will begin to dissolve due to the heat and capsule dissipating action of the running water and eventually release greater quantities of the aromatic gel into the water stream. It must be noted at this point that the capsule will dissolve faster as the water temperature rises, and the process will further be aided by exposing as much of the capsule surface area to the auxiliary stream as possible.

Referring to FIGS. 6, 7 and 8, there is shown a jet nozzle 70 which can be used with the present invention showerhead attachment 10. The jet nozzle 70 has outer threads 72 which are threadedly engaged with the discharge orifice 40 of the dispensing chamber 14. A smaller orifice 74 on the jet nozzle 70 will cause the aromatic auxiliary stream mixture to be ejected as a fine spray which due to the close proximity of the jet nozzle 70 to the shower wall 100, will strike forcefully against the wall and atomize to disperse throughout the bathroom or shower stall atmosphere and thereby create a scented environment.

The present invention conforms to conventional forms of manufacture or any other conventional way known to one skilled in the art. The manufacturing process which could accommodate the construction of the showerhead attachment 10 may be injection, thermoform, etc. or other molding process.

Defined in detail, the present invention is a showerhead attachment for use in conjunction with a water supply conduit and a showerhead for generating aromas, comprising: (a) a cylindrical housing having a circumferential sidewall, a water inlet port being connectable to the water supply conduit, and a water outlet port being connectable to the showerhead, the inlet and outlet ports defining a water flow passage therethrough; (b) a cylindrical shaped dispensing chamber having a circumferential sidewall, an open top end and a closed bottom end, the dispensing chamber integrally formed with the housing such that the top and bottom ends extend through the circumferential sidewall of the housing at opposite locations, the circumferential sidewall of the dispensing chamber having an inlet orifice located in a direction of the water inlet port for diverting a portion of incoming water thereto, and the closed bottom end having a discharge orifice for discharging water from the inlet orifice; (c) an elongated cylinder having an upper cap portion, a side compartment for receiving an aroma containing material, and an open bottom end; (d) a filter assembly for preventing the dissolved aroma containing material from clogging the discharge orifice of the dispensing chamber and including an upper attachment portion with an orifice disk-shaped member, a bottom connection portion with an orifice disk-shaped member, and a disk-shaped filter, the bottom connection portion press fitted to the upper attachment portion such that the filter is sandwiched between the upper and bottom orifice members, and the upper attachment portion inserted into and secured to the open bottom end of the cylinder; and (e) the cylinder and the filter assembly inserted into the dispensing chamber such that the upper cap portion is engaged with the open top end of the dispensing chamber to seal the dispensing chamber and the side compartment of the cylinder is aligned with the inlet orifice of the dispensing chamber; (f) whereby the water is introduced through the water inlet port to be partially diverted through the inlet orifice of the dispensing chamber and flow into the side compartment of the cylinder in intimate contact with the aroma containing material to cause the aroma containing material to diffuse into a flow stream to spray out of the discharge orifice of the dispensing chamber and generating an aromatic environment.

Defined broadly, the present invention is a showerhead attachment for dispensing an aroma containing material, comprising: (a) a housing having a sidewall, an inlet port being connectable to a water supply conduit and an outlet port being connectable to a water spray device, the inlet and outlet ports defining a water passage therethrough; (b) a dispensing chamber having a sidewall and two opposite ends, the dispensing chamber formed with the housing such that the two opposite ends extend through the sidewall of the housing, the sidewall of the dispensing chamber having an inlet orifice located in a direction of the inlet port for diverting a portion of incoming water thereto, and one of the two opposite ends having a discharge orifice for discharging water from the inlet orifice; (c) holding means for receiving and holding the aroma containing material thereto and located within the dispensing chamber opposite the discharge orifice; and (d) filter means positioned within and expanding against the interior periphery of the dispensing chamber and located between the holding means and the discharge orifice for preventing the dissolved aroma containing material from clogging the discharge orifice of the dispensing chamber; (e) whereby the water is introduced through the inlet port to be partially diverted through the inlet orifice of the dispensing chamber and flow into the holding means in intimate contact with the aroma containing material to diffuse into a flow stream to spray out of the discharge orifice of the dispensing chamber and generating an aromatic environment.

Defined more broadly, the present invention is a device for dispensing an aroma containing material, comprising: (a) a housing having a water flow passage; (b) a dispensing chamber mounted to the housing and having an inlet orifice in fluid communication with the interior of the housing and a discharge orifice for discharging a flow stream; (c) holding means for receiving and holding the aroma containing material thereto and located within the dispensing chamber; and (d) filter means positioned within and expanding against the interior periphery of the dispensing chamber and located between the holding means and the discharge orifice for preventing the dissolved aroma containing material from clogging the discharge orifice; (e) whereby the water is introduced into the housing to be partially diverted through the inlet orifice and flow into the holding means in intimate contact with the aroma containing material to diffuse into the flow stream to spray out of the discharge orifice and generating an aromatic environment.

Defined alternatively in detail, the present invention is a method for generating a scented environment by releasing an aroma containing material into the atmosphere, the method comprising the steps of: (a) providing a housing having a sidewall, an inlet port being connectable to a water supply conduit and an outlet port being connectable to a water spray device, the inlet and outlet ports defining a water passage therethrough; (b) forming a dispensing chamber with the housing such that two opposite ends extend through the sidewall of the housing, the dispensing chamber having a sidewall with an inlet orifice located in a direction of the inlet port for diverting a portion of incoming water thereto, and one of the two opposite ends having a discharge orifice for discharging water from the inlet orifice; (c) providing a holding means for receiving and holding the aroma containing material thereto and located within the dispensing chamber opposite the discharge orifice; and (d) expanding a filter means against the interior periphery of the dispensing chamber and located between the holding means and the discharge orifice for preventing the dissolved aroma containing material from clogging the discharge orifice of the dispensing chamber; (e) whereby the water is introduced through the inlet port to be partially diverted through the inlet orifice of the dispensing chamber and flow into the holding means in intimate contact with the aroma containing material to diffuse into a flow stream to spray out of the discharge orifice of the dispensing chamber and generating an aromatic environment.

Defined alternatively broadly, the present invention is a method for generating a scented environment by releasing an aroma containing material into the atmosphere, the method comprising the steps of: (a) providing a housing having a water flow passage; (b) mounting a dispensing chamber to the housing and having an inlet orifice in fluid communication with the interior of the housing and a discharge orifice for discharging a flow stream; (c) providing a holding means for receiving and holding the aroma containing material thereto and located within the dispensing chamber; and (d) expanding a filter means against the interior periphery of the dispensing chamber and located between the holding means and the discharge orifice for preventing the dissolved aroma containing material from clogging the discharge orifice; (e) whereby the water is introduced into the housing to be partially diverted through the inlet orifice and flow into the holding means in intimate contact with the aroma containing material to diffuse into the flow stream to spray out of the discharge orifice and generating an aromatic environment.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modifications in which the present invention might be embodied or operated.

The present invention has been described in considerable detail in order to comply with the patent laws by providing full public disclosure of at least one of its forms. However, such detailed description is not intended in any way to limit the broad features or principles of the present invention, or the scope of patent monopoly to be granted.

What is claimed is:

1. A showerhead attachment for use in conjunction with a water supply conduit and a showerhead for generating aromas, comprising:

a. a cylindrical housing having a circumferential sidewall, a water inlet port being connectable to said water supply conduit, and a water outlet port being connectable to said showerhead, the inlet and outlet ports defining a water flow passage therethrough;

b. a cylindrical shaped dispensing chamber having a circumferential sidewall, an open top end and a closed bottom end, the dispensing chamber integrally formed with said housing such that the top and bottom ends extend through said circumferential sidewall of said housing at opposite locations, the circumferential sidewall of the dispensing chamber having an inlet orifice located in a direction of said water inlet port for diverting a portion of incoming water thereto, and the closed bottom end having a discharge orifice for discharging water from the inlet orifice;

c. an elongated cylinder having an upper cap portion, a side compartment for receiving an aroma containing material, and an open bottom end;

d. a filter assembly for preventing the dissolved aroma containing material from clogging said discharge orifice of said dispensing chamber and including an upper attachment portion with an orifice disk-shaped member, a bottom connection portion with an orifice disk-shaped member, and a disk-shaped filter, the bottom connection portion press fitted to the upper attachment portion such that the filter is sandwiched between the upper and bottom orifice members, and the upper attachment portion inserted into and secured to said open bottom end of said cylinder; and e. said cylinder and said filter assembly inserted into said dispensing chamber such that said upper cap portion is engaged with said open top end of said dispensing chamber to seal said dispensing chamber and said side compartment of said cylinder is aligned with said inlet orifice of said dispensing chamber;

f. whereby the water is introduced through said water inlet port to be partially diverted through said inlet orifice of said dispensing chamber and flow into said side compartment of said cylinder in intimate contact with said aroma containing material to cause said aroma containing material to diffuse into a flow stream to spray out of said discharge orifice of said dispensing chamber and generating an aromatic environment.

2. The showerhead attachment in accordance with claim 1 further comprising a jet nozzle threadedly engaged with said discharge orifice of said dispensing chamber for further generating a fine spray of water.

3. The showerhead attachment in accordance with claim 1 further comprising an O-ring seal installed between the interior of said cap portion and said open top end of said dispensing chamber for making said dispensing chamber water tight.

4. The showerhead attachment in accordance with claim 1 further comprising a sponge inserted into and positioned at said closed bottom end of said dispensing chamber adjacent to said discharge orifice for further preventing the dissolved aroma containing material from clogging said discharge orifice.

5. The showerhead attachment in accordance with claim 1 wherein said disk-shaped filter is a fine wire mesh screen.

6. The showerhead attachment in accordance with claim 1 wherein said water inlet port has inner threads for threadedly engaging with outer threads of said water supply conduit.

7. The showerhead attachment in accordance with claim 1 wherein said water outlet port has outer threads for threadedly engaging with inner threads of said showerhead.

8. A showerhead attachment for dispensing an aroma containing material, comprising:

a. a housing having a sidewall, an inlet port being connectable to a water supply conduit and an outlet port being connectable to a water spray device, the inlet and outlet ports defining a water passage therethrough;

b. a dispensing chamber having a sidewall and two opposite ends, the dispensing chamber formed with said housing such that the two opposite ends extend through said sidewall of said housing, the sidewall of the dispensing chamber having an inlet orifice located in a direction of said inlet port for diverting a portion of incoming water thereto, and one of the two opposite ends having a discharge orifice for discharging water from the inlet orifice;

c. holding means for receiving and holding the aroma containing material thereto and located within said dispensing chamber opposite said discharge orifice; and d. filter means positioned within and expanding against the interior periphery of said dispensing chamber and located between said holding means and said discharge orifice for preventing the dissolved aroma containing material from clogging said discharge orifice of said dispensing chamber;

e. whereby the water is introduced through said inlet port to be partially diverted through said inlet orifice of said dispensing chamber and flow into said holding means in intimate contact with said aroma containing material to diffuse into a flow stream to spray out of said discharge orifice of said dispensing chamber and generating an aromatic environment.

9. The showerhead attachment in accordance with claim 8 further comprising a jet nozzle threadedly engaged with said discharge orifice of said dispensing chamber for further generating a fine spray of water.

10. The showerhead attachment in accordance with claim 8 further comprising a sponge inserted into and positioned adjacent to said discharge orifice said dispensing chamber for further preventing the dissolved aroma containing material from clogging said discharge orifice.

11. The showerhead attachment in accordance with claim 8 wherein said filter means is a fine wire mesh screen.

12. The showerhead attachment in accordance with claim 8 wherein said inlet port has inner threads for threadedly engaging with outer threads of said water supply conduit.

13. The showerhead attachment in accordance with claim 8 wherein said outlet port has outer threads for threadedly engaging with inner threads of said water spray device.

14. The showerhead attachment in accordance with claim 8 wherein said holding means includes an elongated cylinder having an upper cap portion for sealing the other end of said two opposite ends of said dispensing chamber and a side compartment for receiving the aroma containing material.

15. A device for dispensing an aroma containing material, comprising:

a. a housing having a water flow passage;

b. a dispensing chamber mounted to said housing and having an inlet orifice in fluid communication with the interior of said housing and a discharge orifice for discharging a flow stream;

c. holding means for receiving and holding the aroma containing material thereto and located within said dispensing chamber; and d. filter means positioned within and expanding against the interior periphery of said dispensing chamber and located between said holding means and said discharge orifice for preventing the dissolved aroma containing material from clogging said discharge orifice;

e. whereby the water is introduced into said housing to be partially diverted through said inlet orifice and flow into said holding means in intimate contact with said aroma containing material to diffuse into the flow stream to spray out of said discharge orifice and generating an aromatic environment.

16. The device in accordance with claim 15 further comprising a jet nozzle threadedly engaged with said discharge orifice for further generating a fine spray of water.

17. The device in accordance with claim 15 further comprising a sponge inserted into and positioned adjacent to said discharge orifice said dispensing chamber for further preventing the dissolved aroma containing material from clogging said discharge orifice.

18. The device in accordance with claim 15 wherein said filter means is a fine wire mesh screen.

19. The device in accordance with claim 15 wherein said filter means is a fabric mesh screen.

20. The device in accordance with claim 15 further comprising an inlet port having inner threads for threadedly engaging with outer threads of a water supply conduit.

21. The device in accordance with claim 15 further comprising an outlet port having outer threads for threadedly engaging with inner threads of a water spray device.

22. The device in accordance with claim 15 wherein said holding means includes an elongated cylinder having an upper cap portion for sealing said dispensing chamber and a side compartment for receiving the aroma containing material.

23. A method for generating a scented environment by releasing an aroma containing material into the atmosphere, the method comprising the steps of:

a. providing a housing having a sidewall, an inlet port being connectable to a water supply conduit and an outlet port being connectable to a water spray device, the inlet and outlet ports defining a water passage therethrough;

b. forming a dispensing chamber with said housing such that two opposite ends extend through said sidewall of said housing, the dispensing chamber having a sidewall with an inlet orifice located in a direction of said inlet port for diverting a portion of incoming water thereto, and one of the two opposite ends having a discharge orifice for discharging water from the inlet orifice;

c. providing a holding means for receiving and holding the aroma containing material thereto and located within said dispensing chamber opposite said discharge orifice; and d. expanding a filter means against the interior periphery of said dispensing chamber and located between said holding means and said discharge orifice for preventing the dissolved aroma containing material from clogging said discharge orifice of said dispensing chamber;

e. whereby the water is introduced through said inlet port to be partially diverted through said inlet orifice of said dispensing chamber and flow into said holding means in intimate contact with said aroma containing material to diffuse into a flow stream to spray out of said discharge orifice of said dispensing chamber and generating an aromatic environment.

24. The method in accordance with claim 23 further comprising the step of threadedly engaging ajet nozzle with said discharge orifice of said dispensing chamber for further generating a fine spray of water.

25. The method in accordance with claim 23 further comprising the step of inserting a sponge into said dispensing chamber and located adjacent to said discharge orifice for further preventing the dissolved aroma containing material from clogging said discharge orifice.

26. The method in accordance with claim 23 further comprising the step of providing said inlet port with inner threads for threadedly engaging with outer threads of said water supply conduit.

27. The method in accordance with claim 23 further comprising the step of providing said outlet port with outer threads for threadedly engaging with inner threads of said water spray device.

28. A method for generating a scented environment by releasing an aroma containing material into the atmosphere, the method comprising the steps of:

a. providing a housing having a water flow passage;

b. mounting a dispensing chamber to said housing and having an inlet orifice in fluid communication with the interior of said housing and a discharge orifice for discharging a flow stream;

c. providing a holding means for receiving and holding the aroma containing material thereto and located within said dispensing chamber; and d. expanding a filter means against the interior periphery of said dispensing chamber and located between said holding means and said discharge orifice for preventing the dissolved aroma containing material from clogging said discharge orifice;

e. whereby the water is introduced into said housing to be partially diverted through said inlet orifice and flow into said holding means in intimate contact with said aroma containing material to diffuse into the flow stream to spray out of said discharge orifice and generating an aromatic environment.

29. The method in accordance with claim 28 further comprising the step of threadedly engaging a jet nozzle with said discharge orifice for further generating a fine spray of water.

30. The method in accordance with claim 28 further comprising the step of inserting a sponge into said dispensing chamber and positioned adjacent to said discharge orifice for further preventing the dissolved aroma containing material from clogging said discharge orifice.

31. The method in accordance with claim 28 further comprising the step of providing an inlet port with inner threads fir threadedly engaging with outer threads of a water supply conduit.

32. The method in accordance with claim 28 further comprising the step of providing an outlet port having outer threads for threadedly engaging with inner threads of a water spray device.

* * * * *